US008159394B2

(12) United States Patent
Hayes et al.

(10) Patent No.: US 8,159,394 B2
(45) Date of Patent: Apr. 17, 2012

(54) SELECTABLE BEAM ANTENNA

(75) Inventors: David Hayes, Winchester (GB); Richard Brooke Keeton, Beaulieu (GB)

(73) Assignee: Plasma Antennas Limited (GB)

( * ) Notice: Subject to any disclaimer, the term of this patent is extended or adjusted under 35 U.S.C. 154(b) by 502 days.

(21) Appl. No.: 12/448,927

(22) PCT Filed: Jan. 15, 2008

(86) PCT No.: PCT/GB2008/000126
§ 371 (c)(1),
(2), (4) Date: Jul. 15, 2009

(87) PCT Pub. No.: WO2008/087392
PCT Pub. Date: Jul. 24, 2008

(65) Prior Publication Data

US 2010/0079347 A1 Apr. 1, 2010

(30) Foreign Application Priority Data

Jan. 19, 2007 (GB) ..... 0701090.3

(51) Int. Cl.
*H01Q 3/00* (2006.01)

(52) U.S. Cl. ..... 342/368

(58) Field of Classification Search ..... 342/368
See application file for complete search history.

(56) References Cited

U.S. PATENT DOCUMENTS 3,839,720 A 10/1974 Reindel
3,868,695 A 2/1975 Kadak
5,874,915 A 2/1999 Lee et al.
6,292,134 B1 9/2001 Bondyopadhyay
6,400,331 B2 * 6/2002 Kitayoshi ..... 343/793
(Continued)

FOREIGN PATENT DOCUMENTS

EP 1 598 900 A1 11/2005
(Continued)

*Primary Examiner* — Thomas Tarcza
*Assistant Examiner* — Nga X Nguyen
(74) *Attorney, Agent, or Firm* — Iandiorio Teska & Coleman, LLP

(57) ABSTRACT

A selectable beam antenna of generally linear, polygonal, planar or polyhedral form, able to operate at microwave and millimetre wave frequencies, and constructed from associated networks that incorporate radio frequency switches, time delays and amplitude weights positioned within a set of interleaved transmission, lines or waveguides to simultaneously perform both beam-forming and beam selection operations, which selectable beam antenna comprises: (i) a single RP antenna port connected to a 1-to-N corporate feed means, where N is greater than or equal to 2; (ii) a EF switch network means of N/q multi-pole-multi-throw radio frequency switch means (qPMT) connected to the corporate feed means; (iii) a RF distribution means of N×M singularly or multiply interleaved lines arranged so as to have approximately equal transmission length connected to the switch means, where M is the number of throws associated with each radio frequency switch means (qPMT); (iv) an antenna launch means of M×M interleaved antenna element sub-groups of S linear or planar elements, where S is greater than or equal to one, corporately connected to the distribution means and arranged to closely follow at sub-wavelength intervals a closed are or segment of a closed surface; and (v) an overall electronic control means to set all radio frequency switches in such a way to select, to time delay and to amplitude weight the activated interleaved antenna launch elements and thus generate one of the possible directed, antenna beams.

15 Claims, 13 Drawing Sheets

U.S. PATENT DOCUMENTS

| | | | | |
|---|---|---|---|---|
| 6,448,930 | B1 | 9/2002 | Judd | |
| 6,624,720 | B1 | 9/2003 | Allison et al. | |
| 6,831,601 | B1 | 12/2004 | Lopez et al. | |
| 7,248,215 | B2 * | 7/2007 | Pleva et al. | 342/368 |
| 2002/0036586 | A1 | 3/2002 | Gothard et al. | |
| 2004/0027305 | A1 | 2/2004 | Pleva et al. | |
| 2004/0061644 | A1 * | 4/2004 | Lier et al. | 342/368 |
| 2006/0145921 | A1 | 7/2006 | Ranta et al. | |

FOREIGN PATENT DOCUMENTS

| | | | |
|---|---|---|---|
| EP | 1 657 831 | A1 | 5/2006 |
| GB | 1 553 916 | A | 10/1979 |
| GB | 2 111 757 | A | 7/1983 |
| GB | 2 383 689 | A | 7/2003 |
| GB | 2 410 838 | A | 8/2005 |
| JP | 55 124309 | A | 9/1980 |
| WO | WO 2005/006489 | A1 | 1/2005 |

* cited by examiner

DIAGRAM 2A

DIAGRAM 2B

DIAGRAM 7A

DIAGRAM 7B

DIAGRAM 7C

DIAGRAM 7D

DIAGRAM 10A

DIAGRAM 10B

SELECTABLE BEAM ANTENNA

FIELD OF THE INVENTION

This invention relates to a selectable beam antenna and, more especially, this invention relates to a selectable bean antenna that employs a minimum number, or close to minimum number, of low cost radio frequency (RF) switches, time delays and amplitude weights positioned within a set of interleaved transmission lines or waveguides to perform simultaneously both beamforming and beam selection operations.

DESCRIPTION OF PRIOR ART

The technology and application of circular, spherical and other closed surface antenna arrays is well known. In general, such arrays use transmit/receive modules that are independently able to control the amplitude and phase of each element or employ complex beamforming networks based on Fourier (e.g. Butler Matrices) or other orthogonal transformations. Other antenna approaches employ the use of controllable plasma reflectors to select and weight feed lines to such arrays.

BRIEF DESCRIPTION OF THE INVENTION

The present invention aims to simplify, reduce the cost, and extends the range of application of the prior art antenna designs.

Accordingly, in one non-limiting embodiment of the present invention, there is provided a selectable beam antenna of generally linear, polygonal, planar or polyhedral form, able to operate at microwave and millimetre wave frequencies, and constructed from associated networks that incorporate radio frequency switches, time delays and amplitude weights positioned within a set of interleaved transmission lines or waveguides to simultaneously perform both beamforming and beam selection operations, which selectable beam antenna comprises:

(i) a single RF antenna port connected to a 1-to-N corporate feed means, where N is greater than or equal to 2;

(ii) a RF switch network means of N/q multi-pole-multi-throw radio frequency switch means (qPMT) connected to corporate feed means;

(iii) a RF distribution means of N×M singularly or multiply interleaved lines arranged so as to have approximately equal transmission length connected to the switch means, where M is the number of throws associated with each radio frequency switch means (qPMT) (i.e. "q" Poles and MThrows);

(iv) an antenna launch means of N×M interleaved antenna element sub-groups of S linear or planar elements, where S is greater than or equal to one, corporately connected to the distribution means and arranged to closely follow at sub-wavelength internals a dosed arc or segment of a surface; and (v) an overall electronic control means to set all radio frequency switches in such a way to select, to time delay and to amplitude weight the activated interleaved antenna launch elements and thus generate one of the possible directed antenna beams.

The selectable beam antenna is able to achieve simplification due to the interleaved switching network and corporate/cross-over networks exploiting the polyhedral surface geometries which for linear, circular, planar, spherical and cylindrical cases exhibits closed rotational and reflection subgroup topological symmetries for each potential beam position.

The selectable beam antenna may be one in which the interleaved lines are fed from a common corporate feed point, connected, for example, to the radio frequency front end of a communications system or radar sensor. The switched lines may in turn connect to antenna launch elements arranged at sub-wavelength intervals, in such a way to closely follow planar, circular, cylindrical, spherical or other closed surface geometries or sub-regions thereof. When set appropriately, the radio frequency switches allow a contiguous set of adjacent launch elements to be selected and so produce a directed beam, approximately normal to the circumscribing surface of the selected elements. The minimum beamwidth of the directed beam is directly related to the number of elements selected and the associated maximum physical extent of the selected segment.

The selectable launch elements may be of broad angular coverage and may be arranged around a circle. Alternate elements may be selected via two interleaved radio frequency switch networks where all transmission line lengths have been adjusted to be approximately equal, (e.g. to within $\lambda/16$, where $\lambda$ is the wavelength). In this way, 'co-phased' selectable apertures of two element widths have been created. That is, if there are N elements arranged around the circle, there will be N beam positions of equal beam spacing (i.e. 360°/n), each with an effective aperture of almost two elements width. By introducing groups of simply controllable elements at the ends the interleaved transmissions lines the number of selected adjacent elements may be increased and the associated beamwidth reduced and directivity patterns improved. By allowing multiple interleaving and appropriate selectable path length adjustments the number of selectable elements may be further increased. By introducing controllable impedance adjustments within the transmission lines, useful aperture weightings may be included, and so improve further the sidelobe performance of the antenna. Due to the corporate lines being shared between all beam positions, such time and amplitude weights are most economically introduced in the corporate feed to the interleaved networks, but may also be included directly behind groups of antenna elements positioned at the end of the interleaved networks.

In general, a balance will exist between the number of required beams together with their associated beamwidths and the chosen interleaving and selectable path length adjustment strategy. The surface geometry of the antenna determines this adjustment strategy and may be further constrained to minimise the number of low cost radio frequency switches, amplitude weights and printed delay lines. The surface geometry of the antenna can be composed entirely of flat printed patch elements following a wide range of geodesic surfaces such as, regular polygons, Platonic solids or Johnson polyhedra. It is the richness of the rotational and reflection symmetry groups about common vertices, common sides and common faces associated with a particular linear, polygonal or polyhedral topology that will directly determine the degree of simplification possible within the combined beamforming and beam switching network.

The present invention may be constructed on low loss, radio frequency printed circuit boards (PCBs), using freely available, state of the art, low cost, bi-directional, single pole multi-throw radio frequency switches (SPMT) and radio frequency crossover switches, or integrated combinations thereof, that introduce very low insertion losses and obviate the need for any further electronic components, such as expensive phase shifters, quadrature hybrids or quadrature modulators used in other alternative electronically steered antennas. Since the present invention uses wideband switches along with selectable fixed line lengths of wide bandwidth, the overall bandwidth of the antenna is only limited by element designs and the inter-element spacing. Although, not a requirement of the present invention, radio frequency low noise amplifiers, (LNAs) and power amplifiers, (PAs) may be included within the radio frequency interleaved distribution network to improve the overall sensitivity and power handling of the antenna.

The selectable beam antenna may be one in which the corporate feed means and the RF distribution means include transmission line lengths and appropriately weighted splits to produce a required beam pattern, prior to the RF switch network means.

The selectable beam antenna may be one in which the closed arc or segment of the dosed surface is a plane, a cylinder, a sphere or a closed polyhedral surface.

The selectable beam antenna may be one in which each of the S corporate lines to the S individual antenna element contains a time delay and amplitude control means to help compensate for the surface curvature and sub-wavelength sampling, in the form of a set of selectable transmission lines of varying line length.

The selectable beam antenna may be one in which the corporate feed and the radio frequency distribution means make use of the topological rotational and reflection symmetries of the linear, polygonal, planar or polyhedral antenna surface to reduce the overall complexity and associated size of the antenna assembly.

The selectable beam antenna may be one in which the corporate feed and the radio frequency distribution means utilise corporately fed cross-over switch networks to perform useful rotational and reflection permutations that exploit the selectable beam antenna's linear, polygonal, planar or polyhedral topology.

The selectable beam antenna may be one in which the antenna launch means exploits the topological rotational and reflection symmetries of the linear, polygonal, planar or polyhedral antenna surface to reduce the overall complexity and associated size of the antenna assembly.

The selectable beam antenna may be one in which the multiple pole, multiple throw radio frequency switch elements are radio frequency PIN diode switches, radio frequency micro-electromechanical devices or radio frequency plasma distribution devices.

The selectable beam antenna may be one in which the corporate feeds, distribution lines, time delays and amplitude weights that are associated the corporate feed means, the radio frequency switch network means and the radio frequency distribution means are constructed using microwave transmission lines on radio frequency printed circuit board, and the radio frequency switches and radio frequency cross-overs are surface mounted on or wire-bonded to the printed circuit board.

The selectable beam antenna may be one in which the antenna launch means are one dimensional or two dimensional arrays of corporately fed printed dipoles, Vivaldis, Yagis, spirals or patches.

The selectable beam antenna may be one in which the antenna launch means utilises corporately fed cross-over switch networks to perform useful rotational and reflection permutations that exploit the selectable antennas' linear, polygonal, planar or polyhedral topology.

The selectable beam antenna may be one in which the antenna launch means are printed circuit board structures in the form polygonal modules that can be interconnected to form rigid geodesic structures.

The selectable beam antenna may be one in which low noise amplifiers and power amplifiers are introduced into transmission lines to compensate for line losses and distribute power devices to so improve sensitivity and increase power transmitted respectively.

The selectable beam antenna may be one in which the polyhedral structures are be transformed to conform to a geometric surface, such for example as the nose of an aircraft or the windscreen of a car.

The antenna of the present invention may have the following advantageous characteristics.

Minimal, or close to minimal, interconnect strategy.

Compact construction, due to close minimal replication of space consuming time delays.

Low loss and high efficiency, due to interleaved interconnect strategy.

Reliable operation, due to interleaved corporate interconnect strategy.

Wideband operation, due to interleaved interconnect strategy.

Low cost construction using radio frequency PCBs and switch components for beam selection.

Robust construction due to linear, planar or geodesic construction.

Fast beam switching time due to simple interconnect strategy of minimal depth.

Full 360° azimuth operation extendable to full spherical coverage.

Integrated low noise and power amplification for enhanced receiver and transmitter performance.

BRIEF DESCRIPTION OF DRAWINGS

Embodiments of the invention will now be described solely by way of example and with reference to the accompanying drawings in which.

DESCRIPTION OF PREFERRED EMBODIMENTS

Figure 1:
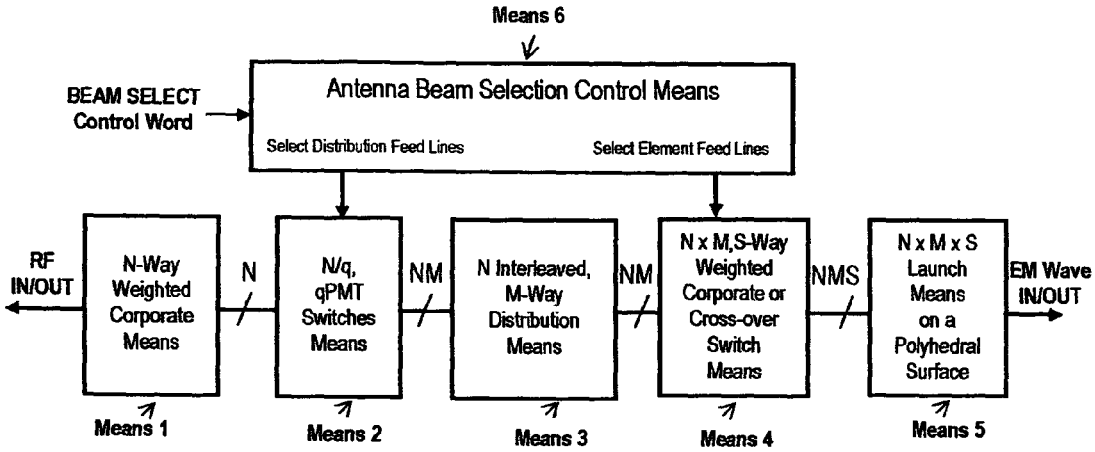
FIG. 1 shows a block diagram of a selectable beam antenna.

Referring to the drawings, the underlying components and scope of the present invention are identified at a top level in FIG. 1. In FIG. 1, a block diagram shows the key elements of the selectable beam antenna.

Referring to FIG. 1 and describing the selectable beam antenna serially from left to right, it will be sent that the antenna interfaces directly to external driver electronics, which might be a communications or radar front end, via a bi-directional radio frequency input/output port. This port connects to an N-way corporate feed with the option to time delay and to amplitude weight the corporate feed's N lines, (Means 1). These N lines feed a switch network which distributes N signals across M lines, where M is greater than or equal to 2. For example, using an N single pole multiple throw switches (SPMT) or a multiple pole multiple throw switch network that employs cross-over switches to permute the corporate feed's N lines, (Means 2). The resulting M×N lines link directly to a set of M interleaved lines, (Means 3). Each interleaved line connects to a further S way corporate feed employing switch or cross-over networks which allow a small number of alternative time delays and amplitude weights to be selected, (Means 4). S is greater than or equal to 1. The S delayed and weighted lines connect directly to an array face of S antenna elements, (Means 5). The N×M array faces are configured to closely follow a line, circle, plane, sphere, cylinder or other dosed geometry and generally will configure a polyhedral surface. Each array face on the polyhedral surface need not be identical and may contain different arrangements of elements spaced at sub-wavelength intervals. The selection of the various switch options is controlled via an external control mechanism, such as a micro-controller, which may, for example, contain a look-up table to generate the necessary switch control lines from a beam select control word, (Means 5).

Thus, the selectable beam antenna, in a preferred embodiment, may be implemented using a hierarchy of interleaved corporate structures, providing lines with controlled time delays and amplitude weights, and multi-pole, multi-throw switches interfaced directly to antenna launch elements, conforming to elementary polyhedral structures. All of which may constructed using low loss dielectric printed circuit boards (PCBs), supported by a mechanical structure or framework and enclosed within a protective radome.

In general, the switch networks are chosen to introduce minimum insertion loss and generally reduce system complexity. This is achieved by exploiting the rotational and reflection symmetries of the antenna's polyhedral array faces and so reducing by decomposition the unnecessary repetition of both switches, amplitude weights and time delays. Furthermore, by utilising high dielectric printed circuit board materials the required corporate feeds, time delays and amplitude weights may be made more compact and the physical surface areas of the distribution networks minimised, thus reducing weight and potentially saving cost.

It is important to recognise that the total switch network for the selectable beam antenna is hierarchical and can usefully be broken down into a 'central distribution board' containing Means 1 to 3 and 'individual array face boards' containing Means 4 and 5. These boards may be linked together using low-loss flexible coaxial cables that allow crossovers to take place so avoiding the need for crossing radio frequency tracks on the radio frequency PCBs. Alternatively, either multilayer boards or passive crossovers may be employed. The hierarchical nature of the selectable antenna allow low noise amplifiers (LNAs) and power amplifiers (PAs) to be distributed in such a way to compensate for unacceptable switch insertion and transmission line losses.

Various configurations will now be described that convey the above preferred features and embodiments. In the following text, these antenna systems will be described in their transmit mode only. Due to the bi-directional nature of all the components (i.e. switches, transmission lines, corporate feeds and antenna elements) that are used, there follows directly, without need for further elucidation herein, a totally reciprocal explanation for the receive mode.

Figure 2:
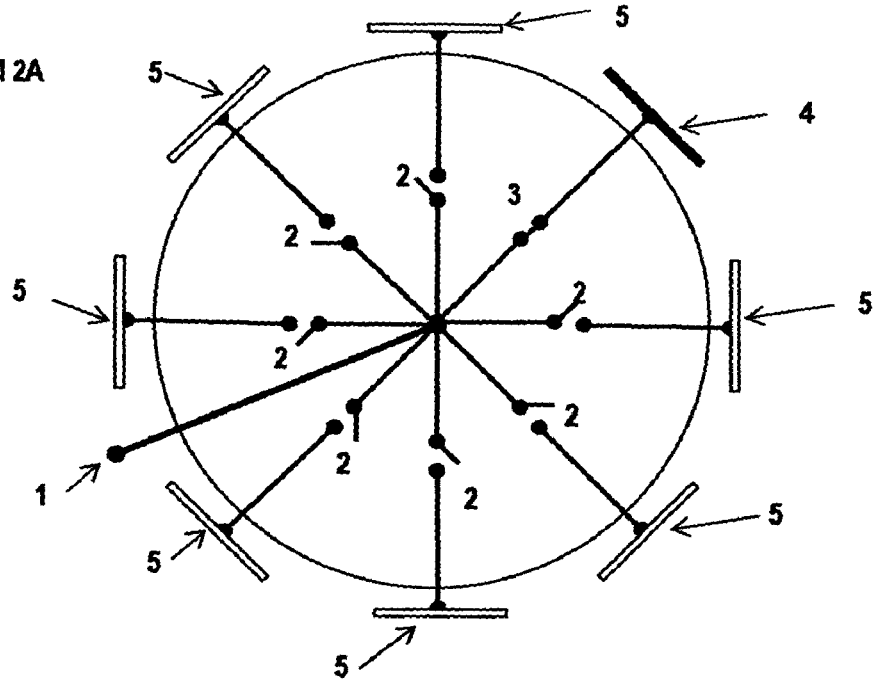
FIG. 2 shows a selectable beam antenna that contrasts a non-interleaved (2A) and a doubly interleaved (2B) switch network.
Figure 2:
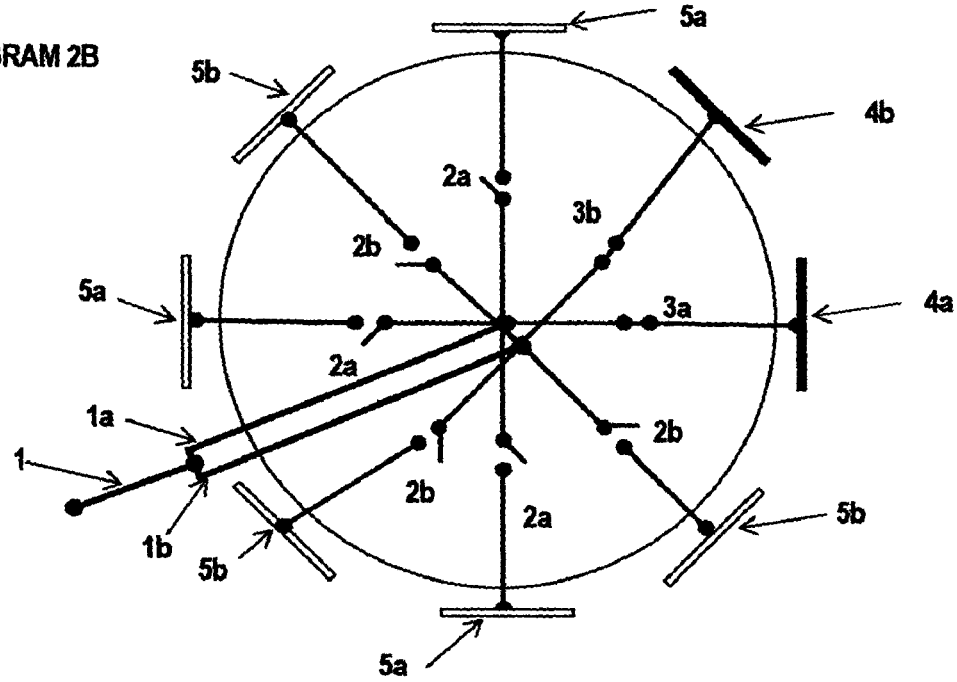

FIG. 2 contrasts a conventional, circular array antenna with an interleaved design. Both designs conform to an octagonal layout of eight antenna elements, such as dipoles. In the conventional design (Diagram 2A) only one element 4, has been selected via switch 3, from input line 1, that is, all other switches 2, and elements 5 have not been selected. Whereas, in the interleaved design, (Diagram 2B), two adjacent elements 4, have been selected by switches 3, from input line 1, that is, all other switches 2, and elements 5 have not been selected. To further understand the differences between the two antenna configurations it is important to appreciate that radio frequency switches are usually designed to select one output port from multiple output ports. Such radio frequency switches can either be designed specifically for purpose or bought as low cost integrated units capable of selecting 1 of n lines, where n is typically 2, 3, 4, 6 or 8. Such switches are designed to have very low insertion losses and operate from DC to the maximum required frequency of the antenna. The greater the number of output ports to select from, the greater will be the switch insertion loss. Thus, the interleaved approach benefits from both lower switch insertion loss and higher antenna gain. The higher antenna gain is achieved due to two adjacent elements having been selected to allow spatial combining. In effect the interleaved design combines both the beamforming and the beam selection operations into one compact, highly efficient network. In the interleaved design, it is important that adjacent lines are kept approximately equal in electrical length. The choice of suitable antenna elements depends mostly on the internal angle between the elements arranged as a polygonal (i.e. the number of elements arranged around the circle) and the elements beam pattern. It is generally required that individual elements have broad angular coverage (ie >90° beamwidth) and are arrayed at less than one wavelength, (e.g. typically at $-\lambda/2$, where $\lambda$ is the shortest operational wavelength required), to avoid destructive interference effects in the far field. Printed patches, Vivaldis, slots, dipoles, Yagis and spirals are all possible elements. To reduce elevation beamwidth and increase overall gain, such elements can be fed stacked and fed corporately, (e.g. the elements and corporate network can be printed on a PCBs mounted at right angles to the plane of the ditribution). Alternatively, an interleaved circular array of printed dipoles allows selectable beams in azimuth with broad elevation coverage from a single circular, planar radio frequency PCB construction.

Figure 3:
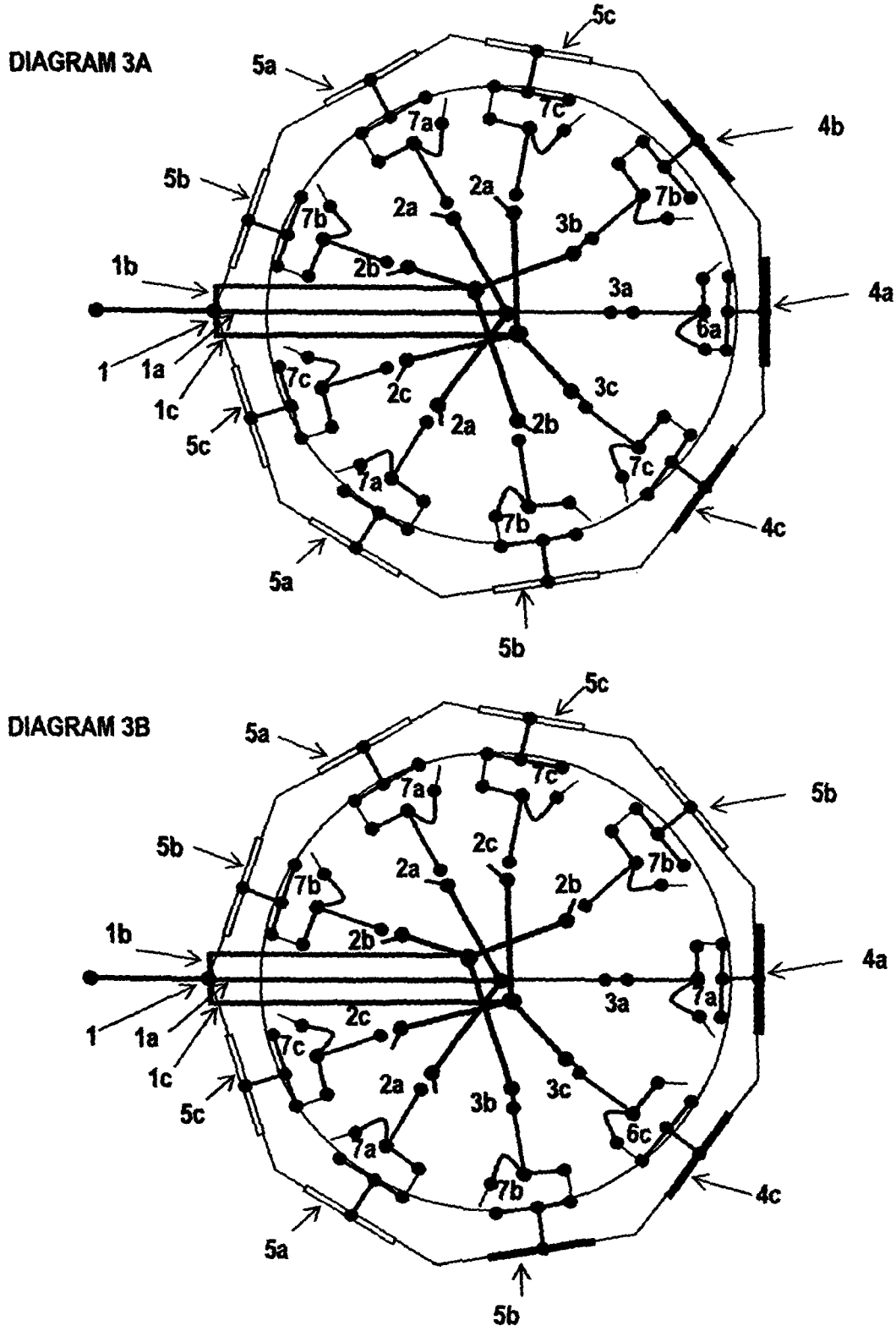
FIG. 3 shows a selectable beam antenna that illustrates a triply interleaved switch network for two adjacent beam positions (3A and 3B)

FIG. 3 indicates in diagrammatic form a selectable beam, circular array antenna conforming to a nine sided equilateral polygon or nonagon, where a three way corporate feed, 1, has been employed to effectively feed, via lines labelled 1*a*, 1*b* and 1*c*, three, single pole three throw (1P3T) switches, shown for clarity in distributed form as {2*a*,3*a*,2*a*}, {2*b*,3*b*,2*b*} and {2*c*,3*c*,2*c*}. Each output line from the three 1P3T switches links to a single antenna element via an alternate path switched delay line. In this way, three interleaved, 3-way distribution networks have been configured. In Diagrams 3A, the three closed switches 3*a*, 3*b* and 3*c* route via 3 alternative path delay lines {7*b*,6*a*,7*c*} to antenna elements {4*b*,4*a*,4*c*}. In Diagrams 3B, the three closed switches; 3*a*, 3*b* and 3*c*, route via 3 alternative path delay lines {7*a*,6*c*,7*b*} to antenna elements {4*a*,4*c*,4*b*}. In effect, Diagrams 3A and 3B show the selected paths and alternative path delay lines, changed in unison to effectively rotate the selected beam by one antenna element position or 360/9°. The central elements having had their outputs appropriately delayed to allow outer elements' outputs to catch up, (i.e. align in time) due to the outer elements being physical set back relative to the centre inner elements. It is noted that the extra delay associated with the increased path length needs to take into account the fact that the signal will travel more slowly along the transmission line than in free space. For example, if the transmission line is a micro-strip line printed on a dielectric constant of E, the signal will travel approximately $\in^{0.5}$ times slower. To improve sidelobes, an amplitude weighting may be applied across the three selected antenna elements. This may be achieved by redistributing or resistively absorbing power, in the non-delayed paths of the alternative path delay lines.

Figure 4:
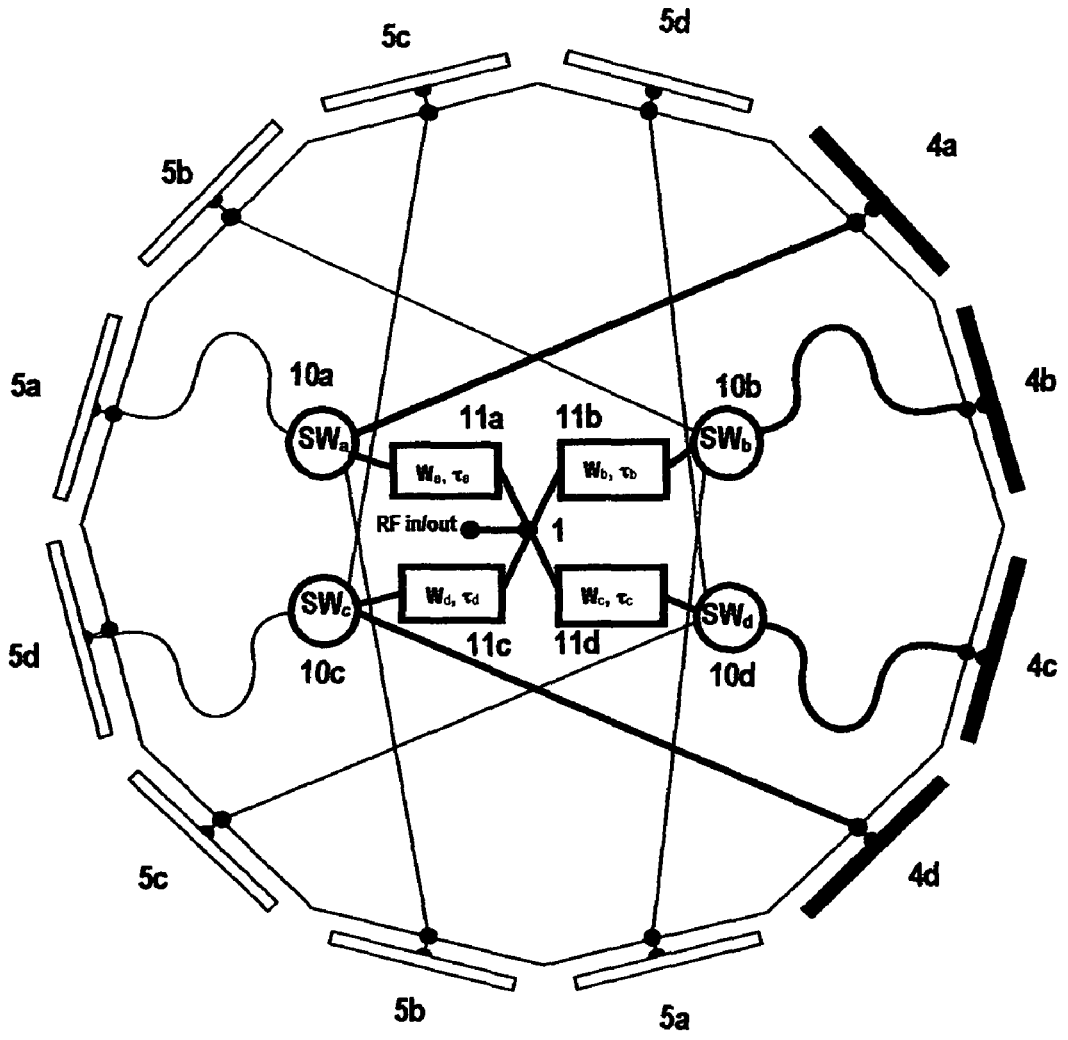
FIG. 4 shows a selectable beam antenna that utilises a corporate network of selectable, amplitude weighted time delays.

For a selectable beam antenna employing a 12-sided equilateral polygonal layout, FIG. 4 shows entire switch network concentrated centrally, with equal path lengths feeding the antenna elements. As with all selectable beam designs described herein, the radio frequency signal first fans out via a corporate feed 1. The fan out is here achieved using a 4-way radial splitter, (termed a combiner on receive), which connects to four switch networks 11*a*, 11*b*, 11*c* and 11*d*, capable of introducing a small number of selectable time delays, $\tau_a$, $\tau_b$, $\tau_c$ and $\tau_d$ and associated amplitude weights $w_a$, $w_b$, $w_c$ and $w_d$. For example, the four time delays might each take two values and the four amplitude weights might each take two values, so making a total of four alternate states for each of the four switch networks. The output from these four switch networks are next distributed, via interleaved lines, among the twelve antenna elements using four 3-way switches. In essence, the switch networks, 11*a*, 11*b*, 11*c* and 11*d*, performs exactly the same function as the alternate path delay lines, described in detail for FIG. 3 and labelled '6 ' or '7 ' according to their state, except the switch network has been simplified in that the time delays and amplitude weights are no longer duplicated for each antenna element. This simplification is achieved by introducing the weights immediately after the corporate split and before the multi-way switches and associated interleaved lines. The simplification is possible because the four switch networks allow any four adjacent antenna elements to be selected and any combination of delays and weights to chosen for any element. As with the system shown in FIG. 3, the time delays are use to align the wavefronts leaving the antenna elements and the amplitude weights to apply a taper across the combined wavefront. It should be noted that the functionality of 11*a* to 11*d* could be achieved using phase shifters and attenuators. However such an approach requires much more complex and expensive components.

Figure 5:
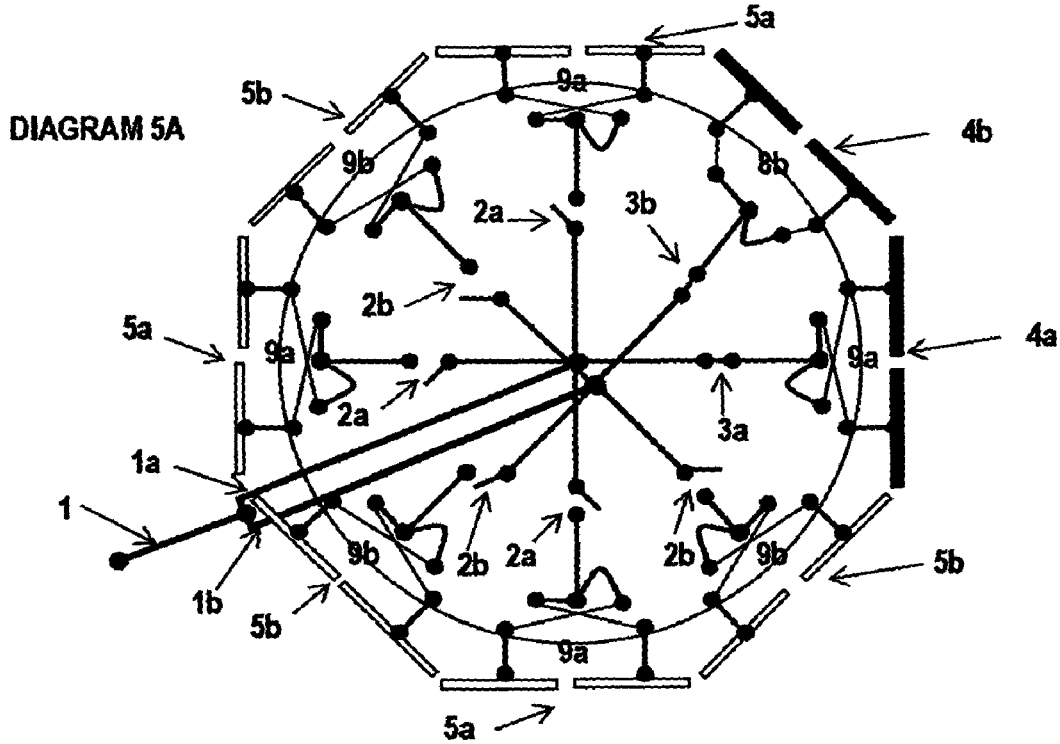
FIG. 5 shows a selectable beam antenna that shows a doubly interleaved network feeding paired elements fed through controllable cross-over switches for two adjacent beam positions (5A and 5B)
Figure 5:
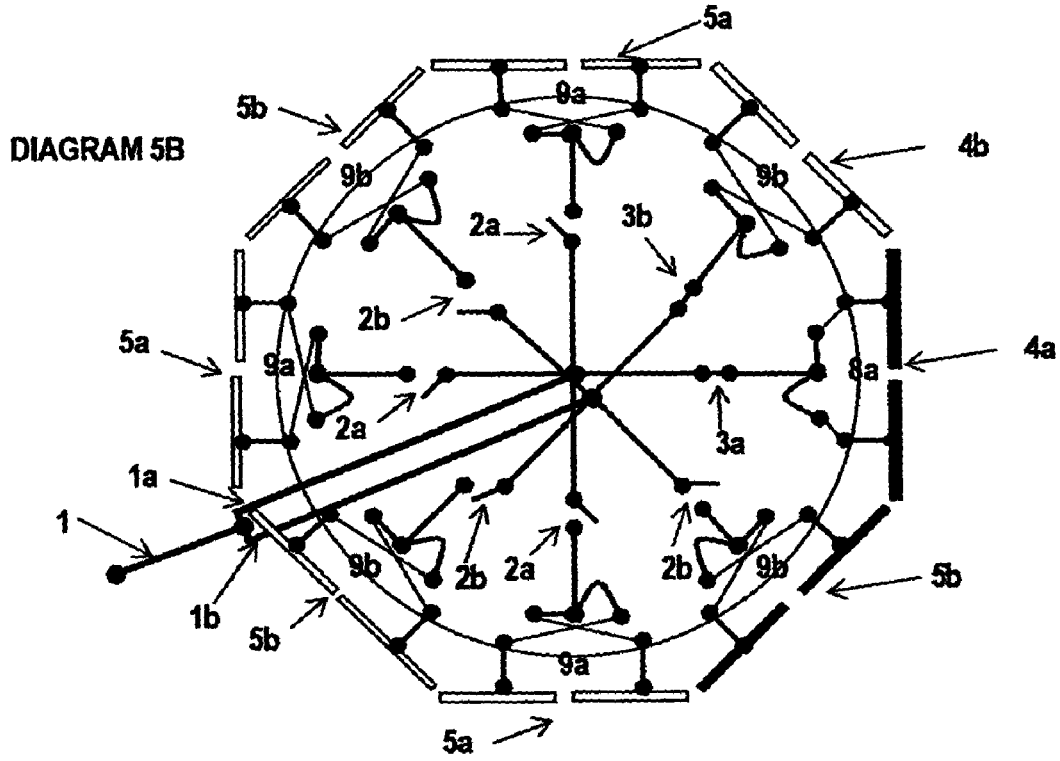

FIG. 5 illustrates a doubly interleaved selectable beam antenna based upon an octagonal configuration of antenna elements, where the antenna elements are fed in linearly arranged adjacent pairs, (e.g. double patches, slots etc). The operation of this antenna is exactly as described previously for FIG. 2, except that crossover switches 8*a* to 8*b* or 9*a* to 9*b*; designated according to state, have been introduced immediately before the said pairs of antenna elements. That is, each switch configuration has different fixed delays (i.e. states) in the two selectable crossover paths, (e.g. as shown as 9*a* in Diagram 5A and 8*a* in Diagram 5B). In effect, these crossover switches allow appropriate delays to be introduced in the lines feeding the antenna elements as different beams are selected, as illustrated in Diagrams 5A and 5B. The said crossover switches perform local permutations with generally less insertion loss than the single pole multiple throw switches. Explained slightly differently, the pair of antenna elements may be configured to have a leftward or rightward pointing directivity pattern, when combined spatially, which is able to alternate in direction according to the state of the crossover switch. The selectable beam antenna shown in FIG. 5 may employ in a preferred embodiment separate radio frequency PCBs containing both the crossover switches and printed pairs of patches, slots or other antenna elements. It is noted that in the case of dual polarization patches further multi-way switches may be used to select between different polarizations.

Figure 6:
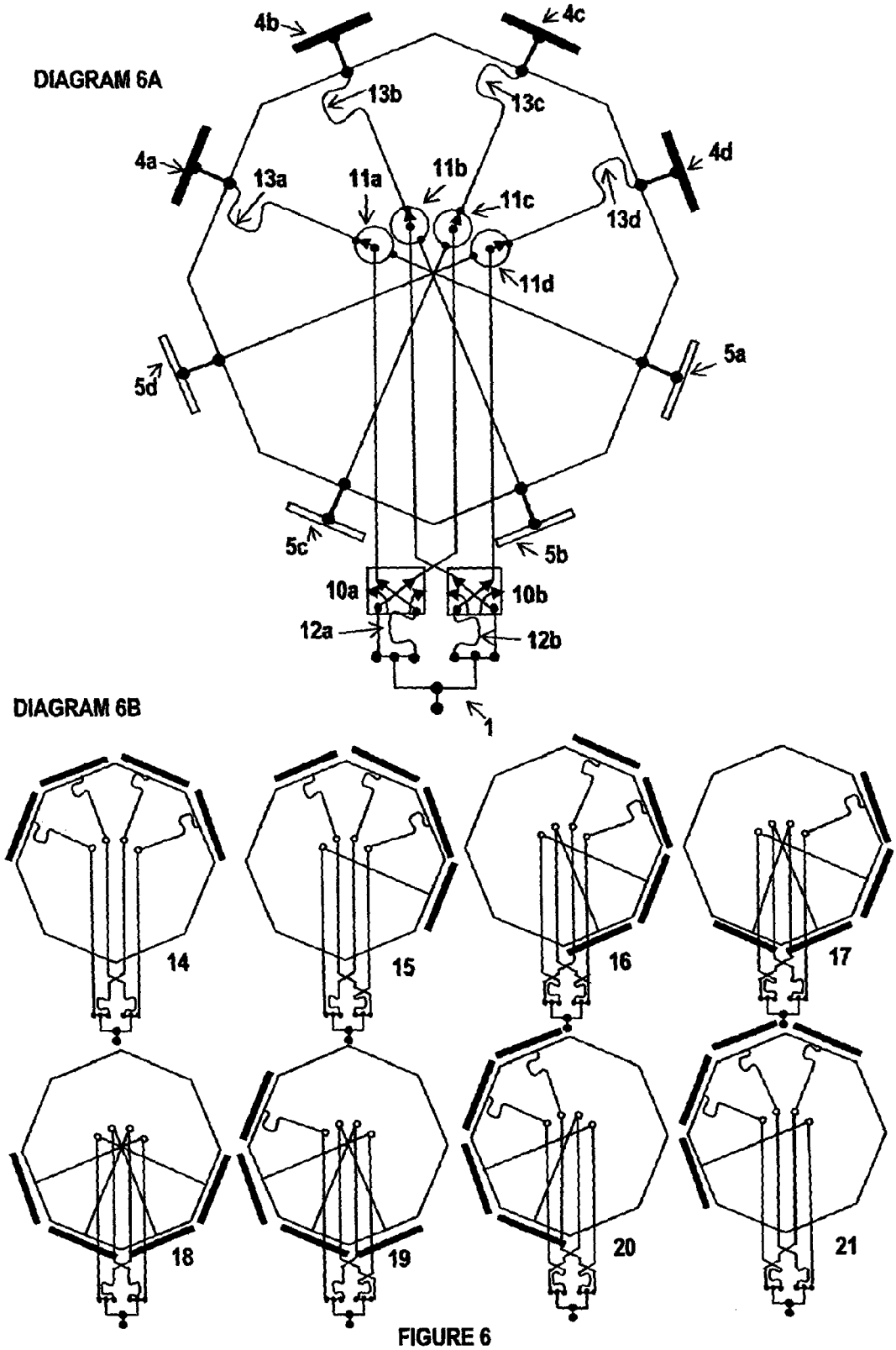
FIG. 6 shows a selectable beam antenna that shows a quadruply interleaved network feeding octagonally arranged elements, fed through a pair of controllable cross-over switches for eight adjacent beam positions (6A and 6B)

The efficient use of crossover switches within a selectable antenna is illustrated in FIG. 6. Referring to Diagram 6A, the radio frequency signal is introduced via the radio frequency port 1. The radio frequency signal is split corporately, as shown, between two cross-over switches 10*a* and 10*b*, where each crossover switch has a delay 12*a* and 12*b* respectively, in one of its two input paths. The four outputs from the two crossover switches are then fed to four 2-way switches (1P2T), 11*a* to 11*d*, which alternatively select and interleave the signals across a circular array of eight antenna elements arranged as an octagon, in such a way that adjacent antenna elements (e.g. 4*a*, 4*b*, 4*c* and 4*d*) are always selected and appropriately time delayed. All interleaved feed lines to the antenna elements from the multi-throw switches are compensated to be equal in length by adding extra line lengths 13*a* to 13*d*. For clarity, Diagram 6B shows in eight sub-diagrams, labelled 14 to 21, which the four combined states of the crossover switches and the two states of the double throw interleaving switches allow all four adjacent elements to be cycled around. In effect, the combination of cross-over switches and multi-throw switches provide all necessary route permutations.

The approach just described for a selectable beam antenna in FIG. 6 can readily be extended to any polygonal antenna arrangement that can be interleaved, (i.e. a polygon arrangement with divisible number of sides) and requires a selection of 'n' adjacent elements, provided 'n' is cyclically permutable, using a network of cross-over switches. Alternatively, the number of elements may be increased by pairing the elements in the way described in the text associated with FIG. 5. Different delays and weights may be added to cope with different antenna surface curvatures extending over more elements by increasing the number of switch positions associate with the switch networks. Any reflection symmetry halves the required number of time delays and amplitude weights.

Figure 7:
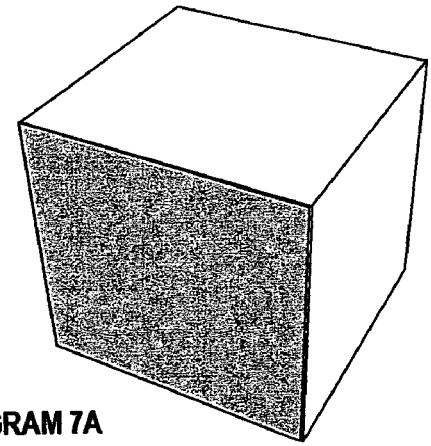
FIG. 7 shows four suitable polyhedral surfaces (7A, 7B, 7C & 7D) for a selectable beam antenna.
Figure 7:
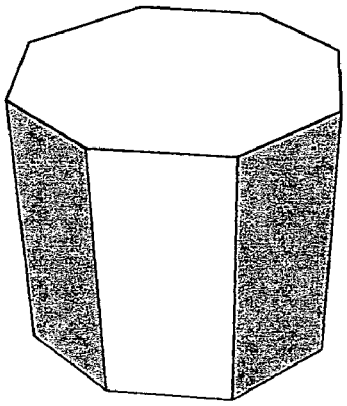
Figure 7:
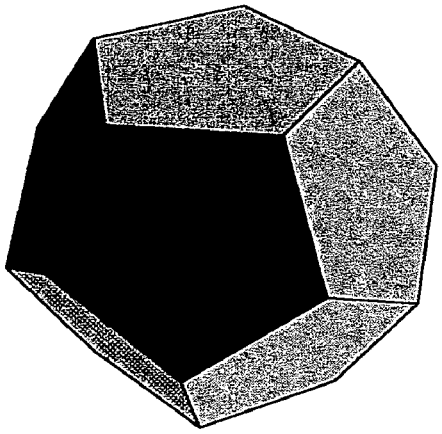
Figure 7:
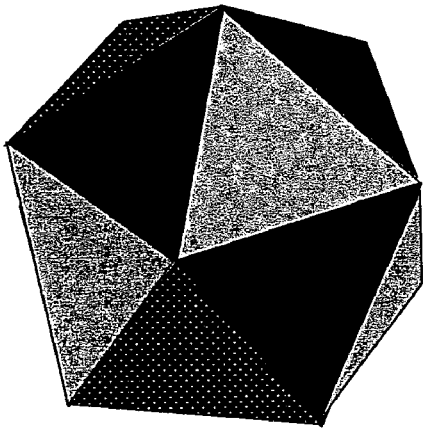

FIG. 7 illustrates a number of polyhedra with topologies suitable for the array faces of selectable beam antennas, some of which are able to provide full spherical coverage. Diagram 7A shows a cube with alternate sides shaded. Diagram 7B shows at sided polyhedra with a two octagonal sides (top and bottom) and eight rectangular, (or square) sides. Diagram 7C shows a dodecahedron, a Platonic solid made up of twelve pentagonal faces. Diagram 7D shows an icosahedron, a Platonic solid made up of twenty regular triangular faces. As well as the Platonic solids, there are Archimedean, Johnson and other well known forms of polyhedra. Such polyhedra can be extended to further useful geodesic forms by truncation relative to a circumscribing sphere, whose radius is allowed to vary and act as a truncation threshold around vertices protruding through the sphere. In general, any polyhedron, or contiguous subset thereof, that is made up of a relatively small number of regular polygonal face types provides a useful surface for a selectable beam antenna, especially if there exists reflection symmetries about vertices and rotational symmetries about polygonal array faces. That is, each array face, side or vertex of the polyhedron can act as centre of symmetry about which an extended antenna aperture can be formed. The time delays and amplitude weights associated with producing a beam that is suitable for one face will repeat for all similar geometries under reflection and rotation. Using the spherical thresholding process described above, polyhedra may be found to support almost any level of beam pointing granularity and beam shape It is also noted that polyhedra conforming to a sphere can be unambiguously transformed, (or mapped), on to surface of similar topology such as a curved nose cone of an aircraft, thus allowing for the possibility of significantly simplifying the electronic complexity of conformal arrays. The corporate feeds, the crossover networks, the multi-throw switching networks and the interleaved lines for these polyhedral configurations are essentially as previously described, except the alternate feed lines need to be routed in three dimensions to the array faces and the number of interleaved feed lines depends on how many adjacent surfaces need to be addressed simultaneously.

Some selectable beam antennas based around polyhedral geodesic surfaces will now be discussed in terms of their preferred embodiments.

Figure 8:
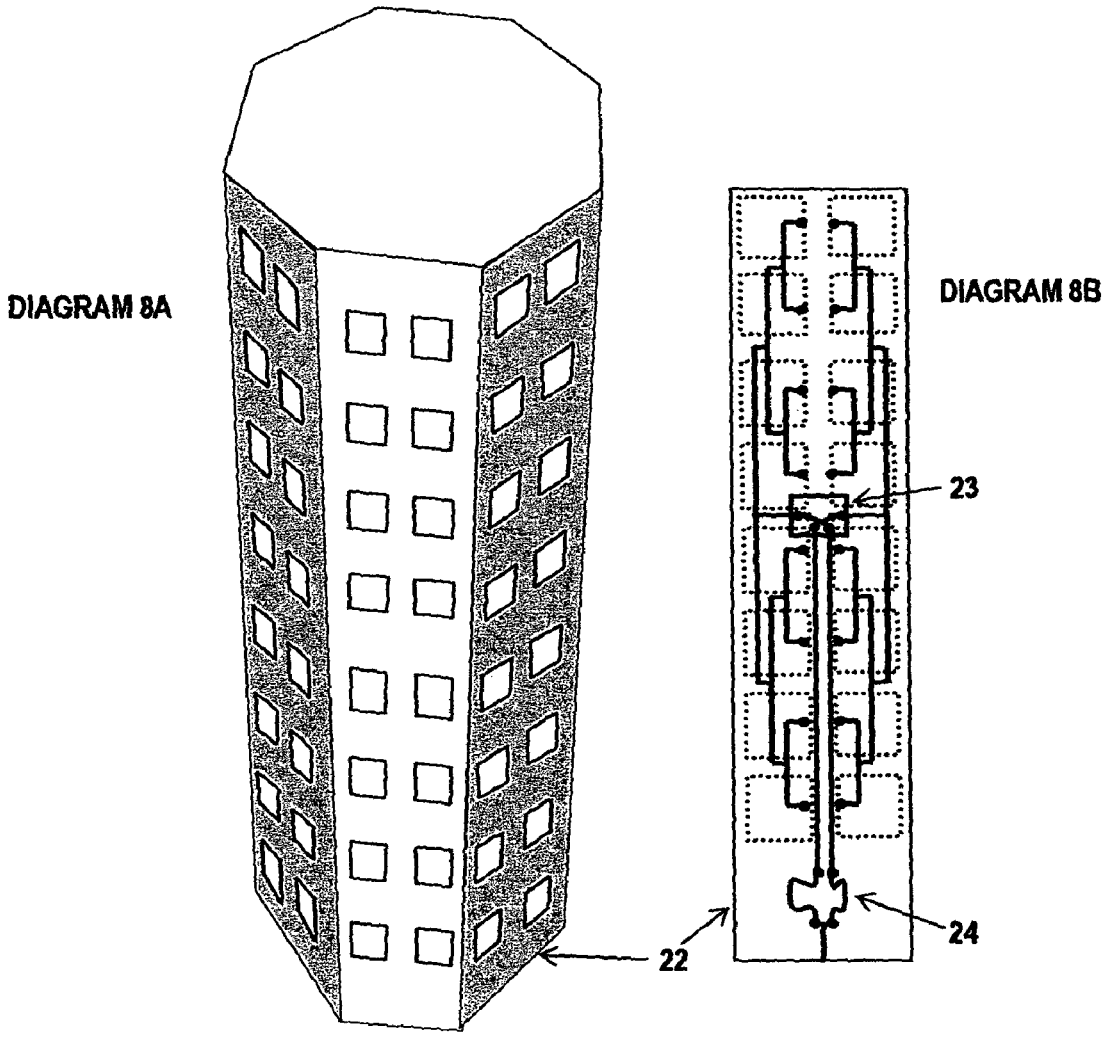
FIG. 8 shows a selectable beam antenna (8A) utilising a corporately fed group of launch elements (8B)

In FIG. 8, Diagram 8A shows a selectable beam antenna based on a ten sided polyhedron configuration, eight octagonal sides of which are active. The antenna element selection of two adjacent, inclined faces, with each face containing two adjacent elements, has already been described in the context of FIG. 5. In Diagram 8B, the two elements have been increased to two corporately fed columns printed on a common PCB substrate 22. The PCB also contains the radio frequency crossover switch 23, with asymmetric track lengths 24, in corporately fed input lines to provide the pattern alignment between adjacent boards. The complete antenna configuration provides a cost effective way of achieving 360° coverage using eight 45° beams, suitable for a WiMAX basestation. At a centre frequency of 5.5 GHz such a configuration would be approximately 20 cm in diameter by 40 cm in height and would provide around 20 dBi of gain, switch and system losses having been taken into account.

Figure 9:
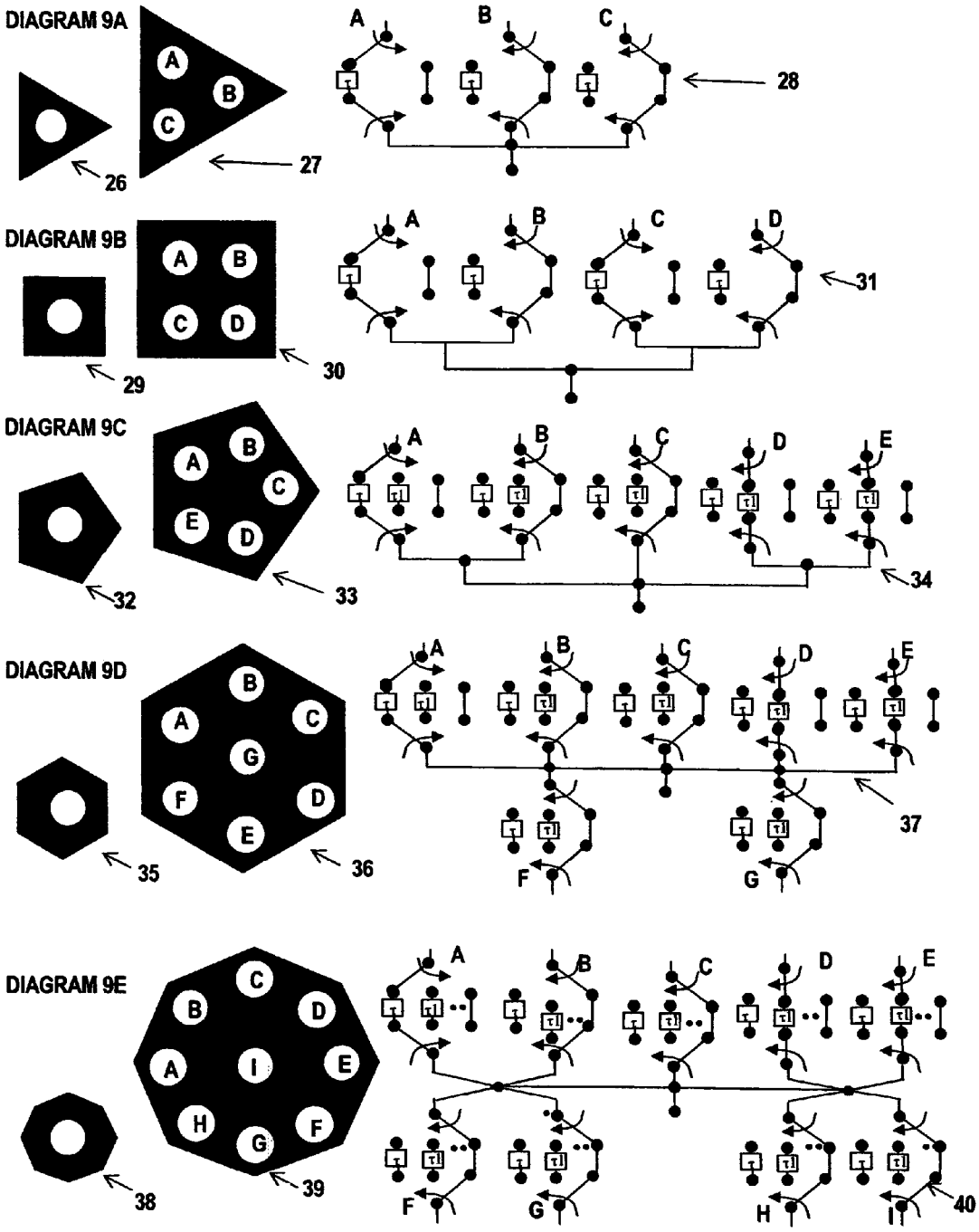
FIG. 9 shows five examples (9A to 9E) of polygonal element structures and their associated corporate time delays suitable for use within a selectable antenna.

FIG. 9 illustrates various arrangements of antenna elements on regular polygonal faces. The antenna elements are depicted as circular patches on printed circuit board (PCB) modules. The PCB modules are suitable for selectable beam antennas based on polyhedral configuration. Diagram 9A shows a triangular board with both a single and a triple configuration of elements 26 and 27. For the single patch case 26, no further 'on-board' circuitry is necessary. For the triple patch case 27, extra circuitry is required to allow two adjacent triangular boards to align their beam patterns about their common sides, there being three such circumstances. The necessary circuitry 28, is illustrated as three paired SPDT switches with time delays, of length almost zero (or $\tau 0$) in their alternative paths. The use of paired switches in series on both input and output ensures a good match and high isolation. Diagrams 9B to 9E illustrate square, pentagonal, hexagonal and octagonal cases. For single patches, 29, 32, 35 and 38, no extra circuitry is required. For multiple patch layouts, 30, 33, 36 and 39, extra circuitry is required to allow beam alignment across common sides. The extra circuitry, 31, 34, 37 and 40, increases in complexity with increasing numbers of patches. An extra time delay is required for each different distance between the common side and the centre of each patch. For example, for the pentagonal case, three different delays, $\tau$, $\tau 1$, $\tau 0$ are necessary and for the octagonal case five delays, $\tau$, $\tau 1$, $\tau 2$, $\tau 3$, $\tau 0$ are required. It will be noted that due to symmetry the number of delays is n/2 or n/2+1, where n is the number of sides to the polygon. It will be further noted that multiple faces may be associated about common vertices, under these circumstances the alternative delays must be relative to the distances of the individual patches to the common vertex rather than the common side. Similarly, multiple faces may be associated with common centre array face, under these circumstances the alternative delays must be relative to the distances of the individual patches to the common face. Clearly, sides, vertices and centre faces are can all be used provided the correct number of predetermined delays has been incorporated in the extra circuitry.

Figure 10:
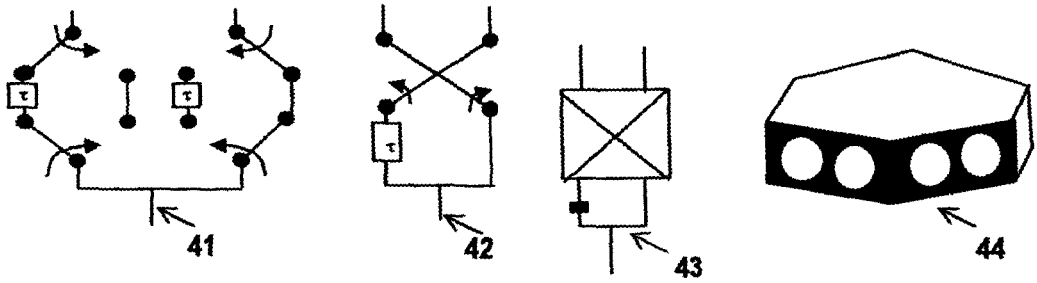
FIG. 10 shows two examples of the use of low loss controllable cross-over networks within selectable beam antennas.
Figure 10:
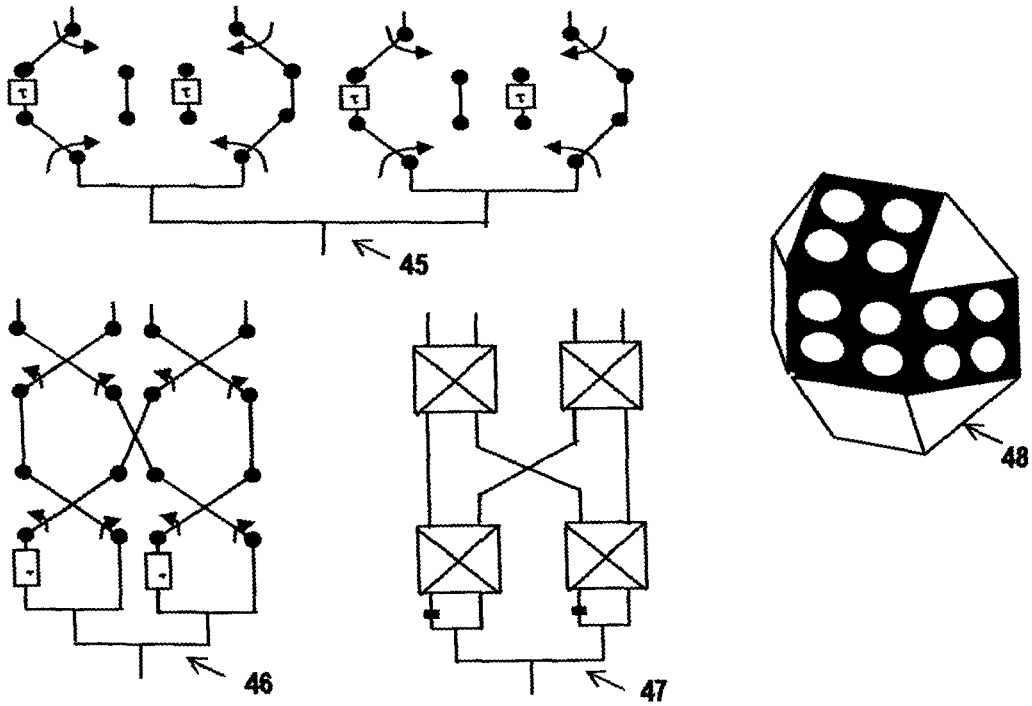

FIG. 10 indicates how crossover switches may sometimes be used within a selectable beam antenna as alternatives to sets of single pole multiple throw switches, SPMTs. Diagram 10A shows two adjacent array faces of an eight sided polyhedra based on an hexagonal array face configuration 44. The basic beamforming network based upon alternative timed delays 41, is contrasted with the equivalent cross-over network 42. In certain technologies (e.g. PIN switches), the insertion loss of the cross-over network is often less due to only one level of switching being required to properly match the radio frequency ports. Moreover, the crossover circuitry can be more compact since the time delays are not repeated. For later clarity, a simplified diagram for the crossover switch has been given, 43. Diagram 10B shows three adjacent array faces for a ten sided polyhedra based mostly upon an inclined array of five square faces 48. The basic beamforming circuitry for any array face has to allow for either horizontal or vertical pairing of adjacent faces. Circuitry that uses single level, multiple SPMT switches 45, is contrasted with an equivalent crossover network, 46. An equivalent diagrammatic representation 47, makes it clear that two levels of crossover switching are required for the two dimensional case considered here and as a result there is likely to be no advantage in improved insertion loss over the multiple SPMT case 45. However the time delays need only be repeated twice rather than four times. It should be noted that the multiple SPMT configuration allows for equal time delays being applied to all antenna elements, which is useful when the centre array face is reference to its surrounding neighbours.

Figure 11:
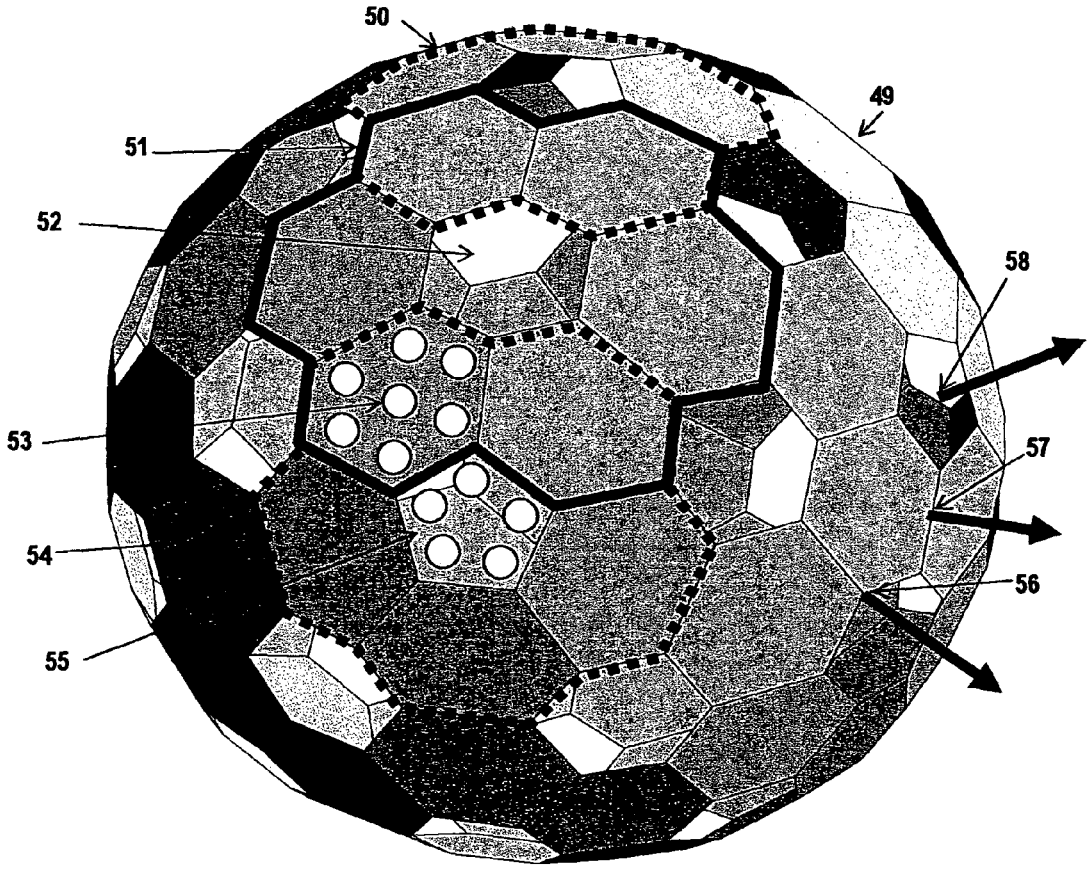
FIG. 11 shows an example of a polyhedron utilising both hexagonal and pentagonal element launch structures within selectable beam antenna providing full spherical coverage.

To illustrate further the advantageous use of rotational and reflection symmetries in the context of selectable beam antennas, FIG. 11 shows a fully spherical geodesic array face based upon a doubly truncated icosahedron 49. Firstly, it is noted that adjacent array faces may grouped together 51 and 54, around central array faces 52 and 55. In this example, the central faces have been created by truncating the icosahedron about it vertices and are therefore easily denumerated. Secondly, it is noted that group 50, is a rotation and reflection of 54, and therefore can use the same time delay and amplitude weight setting. If these settings are placed in common central switching network, as discussed in the context of FIG. 6, there is no need for replication, with associated savings in space and cost, moreover the number of replications of such sub-groups is generally greater for polyhedral surfaces than polygonal geometries. Thirdly, it is noted that centre face arrays with multiple elements 52 and 55, can simply be corporately fed with further time delays. However surrounding multi-element adjacent faces do need to be time delayed and amplitude weighted according to the curvature and frequency of operation.

In general, the decomposition of the geodesic surface into appropriate sub-groups will depend on the required beamwidth and required fields of view of the selectable beam antenna. The greater the number of rotational and reflection groups within the polyhedral topology the greater the number of potential beam positions. These beam positions will about radial lines through common vertices 56, common sides 57, and common centre array faces 58, as these are the principle axes of symmetry. Moreover, by employing these basic topological constraints, together with certain polarisation restrictions (e.g. the antenna elements are circularly polarised for a spherically based topology), the resulting beam patterns will be largely symmetric about most axial cuts. It is finally noted that for certain polyhedra the sides may not always be regular polygons. In such cases, the required time delays may still be reduced to a very small set on the bases of acceptable perturbations in beamwidth and sidelobes.

Figure 12:
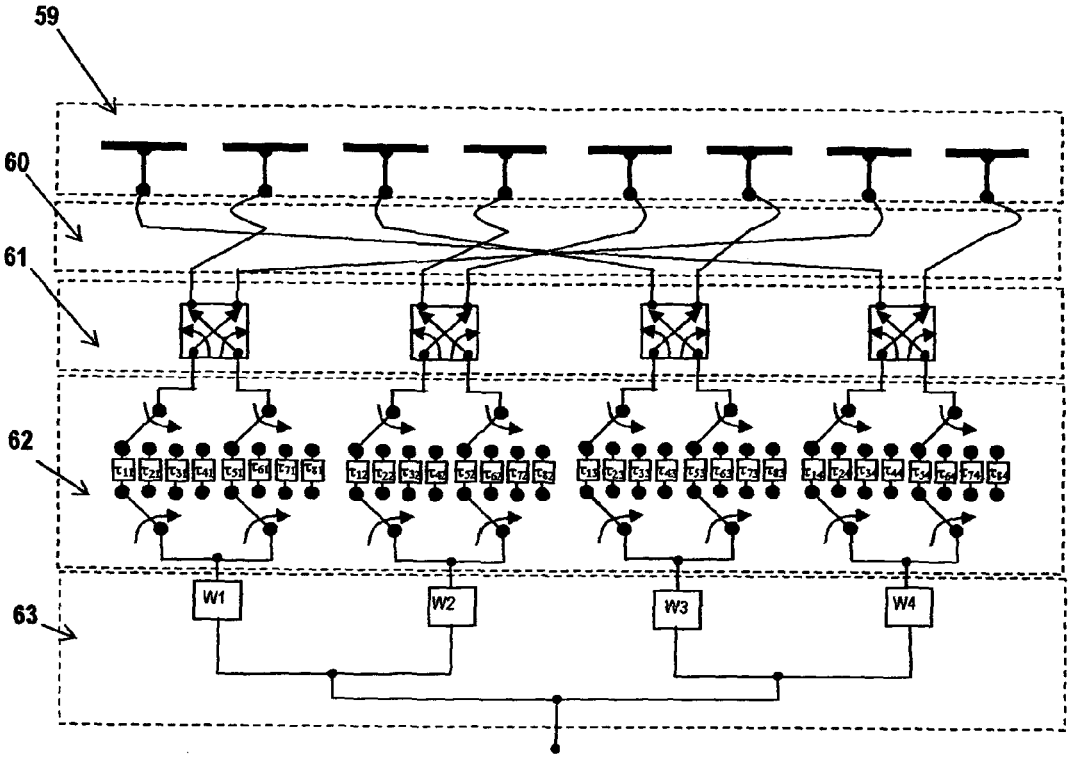
FIG. 12 shows an example of a selectable beam antenna utilising the reflection symmetry of linear array to reduce the number of switch elements, amplitude weights and time delays.

In FIG. 12, by way of illustration, an eight element linear array of antenna 59 is depicted connected via a multiple interleaving network, 60, to a group of four 2-way cross-over switch networks 61, to an eight unit time delay switching network 62, which is fed by a 4-way amplitude weighted corporate feed 63. It will be noted that reflection symmetry about the centre of the linear array has been exploited to allow left and right time delay steering, for eight angular settings of the array, using half the number of switches and time delays required by a more conventional approach. That is, the multiple interleaving network 60, actually selects pairs of array elements, starting with the middle pair and finishing with the outer pair, transmission line path lengths between all tracks are equalised. Note that this pair-wise interleaving operation is a simple hardwired permutation process requiring multiple radio frequency tracks to crossover. When connected to the four 2-way crossover switches, 61, this multiple interleaving process allows one half of the array to be exchanged with the other half of the array. Using the eight unit time delay, one of four, incremental time delay vectors ($t_{r1}$, $t_{r2}$, . . . $t_{r8}$) are distributed across the array, where r=1, 2, 3 or 4. The four 'reverse order' delays are produced by simply switching the crossover switches. The 4 way, amplitude weighted corporate feed distributes a symmetric amplitude taper (i.e. W4, W1, W3, W2, W2, W3, W1, W4 for the way labelled and drawn) across the array face.

The decomposition as described may easily be extended to other sizes of linear array. When the number of elements is odd, the centre element is pivoted around and, as such requires no selectable time delay or cross-over and simply takes its input directly from the amplitude weighted corporate feed, with its feed length appropriately equalised relative to the other elements.

Figure 13:
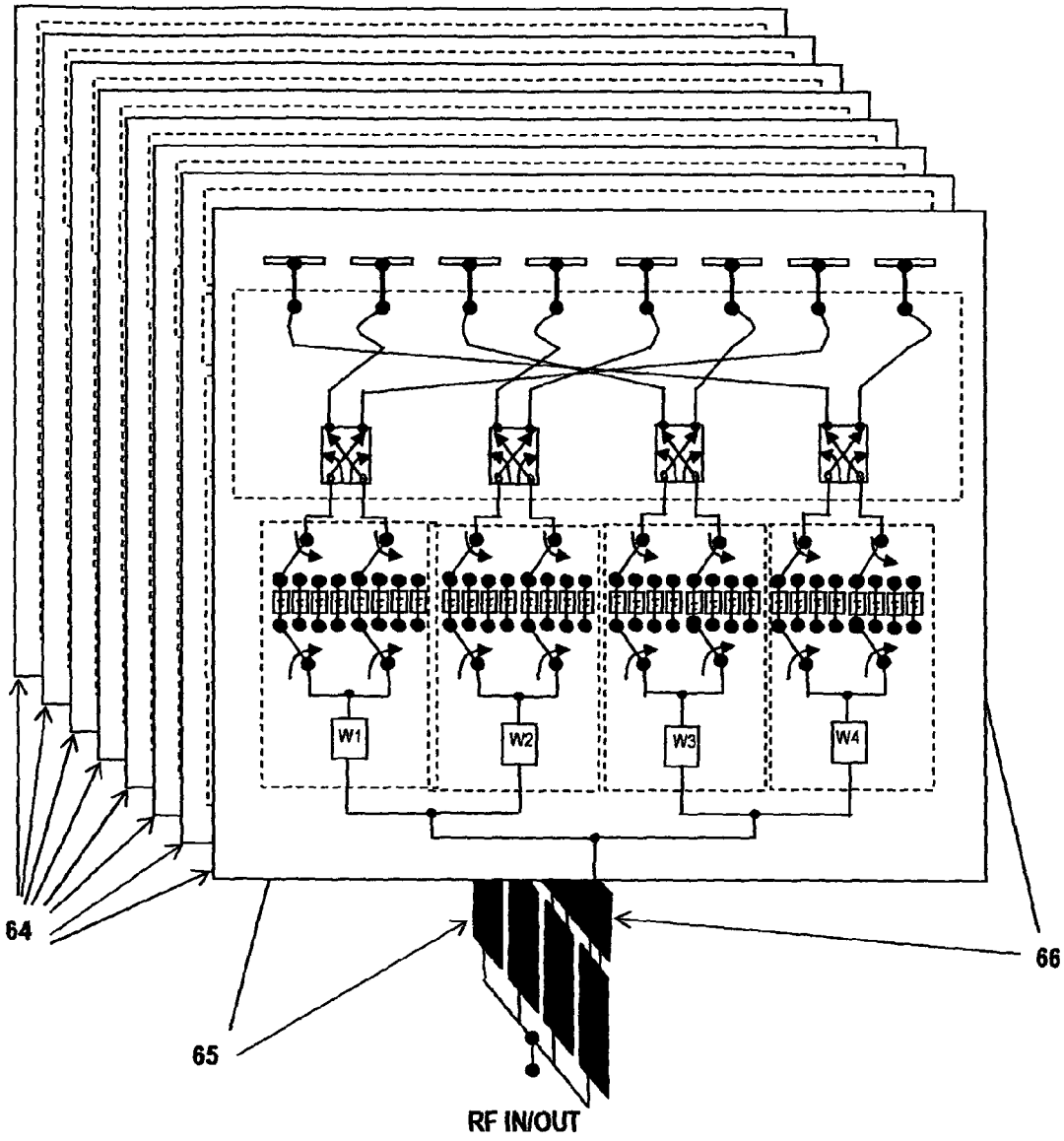
FIG. 13 shows an example of a selectable beam antenna utilising two dimensional reflection symmetry for a planar array to provide full two dimensional scanning and to reduce the number of switch elements, amplitude weights and time delays.

The approach may naturally be extended to two dimensional beamsteering for a square or rectangular array face, using the orthogonal decomposition shown FIG. 13. Here, the network shown in FIG. 12 has been repeated eight times, 64. The network has been broken down into a crossover network 65, and four time delay/amplitude weighting selection modules 66. The eight networks are connected orthogonally to the network shown in FIG. 12, with its eight antenna elements removed. In order to make up for switch losses PA and LNA amplification may usefully be introduced at this point. The crossover network, 65, and selection modules 66, may be used.

This basic orthogonalisation may be used with any size of regularly arranged n by m array of elements, for p×q beam positions. The array elements should be spaced to avoiding grating lobes at the maximum frequency of operation. In terms of construction, the layout of FIG. 13 suggests a rack of radio frequency PCBs may be suitable approach. However, it should be recognised that numerous other printed layout are possible, provided equal transmission line lengths can be maintained without introducing too much loss. For example, the whole 2D switched beam structure may be configured on a single board and used as part of a polyhedral array, previously described within the context of FIG. 11. In general, by utilising the crossover network, 65, and selection modules, 66, significant saving in radio frequency switch matrix complexity will result for all such rectangular planar array faces.

The invention claimed is:

1. A selectable beam antenna of generally linear, polygonal, planar or polyhedral form, able to operate at microwave and millimeter wave frequencies, and constructed from associated networks that incorporate radio frequency switches, time delays and amplitude weights positioned within a set of interleaved transmission lines or waveguides to simultaneously perform both beamforming and beam selection operations, which selectable beam antenna comprises:

a single RF antenna port connected to a 1-to-N corporate feed means, where N is greater than or equal to 2;

(ii) a RF switch network means of N/q multi-pole-multi-throw radio frequency switch means (qPMT) connected to corporate feed means;

(iii) a RF distribution of N×M singularly or multiply interleaved lines arranged so as to have approximately equal transmission length connected to the switch means, where M is the number of throws associated with each radio frequency switch means (gPMT);

(iv) an antenna launch means of N×M interleaved antenna element sub-groups of S linear or planar elements, where S is greater than or equal to one, corporately connected to the distribution means and arranged to closely follow at sub-wavelength internals a closed arc or segment of a surface; and (v) an overall electronic control means to set all radio frequency switches in such a way to select, to time delay and to amplitude weight the activated interleaved antenna launch elements and thus generate one of the possible directed antenna beams.

2. A selectable beam antenna according to claim 1 in which the corporate feed means and the RF distribution means include transmission line lengths and appropriately weighted splits to produce a required beam pattern, prior to RF switch network means.

3. A selectable beam antenna according to claim 1 in which the closed arc or segment of the surface is a plane, a cylinder, a sphere or a closed polyhedral surface.

4. A selectable beam antenna according to claim 1 in which each of the S corporate lines to the S individual antenna elements contains a time delay and amplitude control means to help compensate for the surface curvature and sub-wavelength sampling, in the form of a set of selectable transmission lines of varying line length.

5. A selectable beam antenna according to claim 1 in which the corporate feed and the RF distribution means make use of the topological rotational and reflection symmetries of the linear, polygonal, planar or polyhedral antenna surface to reduce the overall complexity and associated size of the antenna assembly.

6. A selectable beam antenna according to claim 1 in which the corporate feed and the radio frequency distribution means utilize corporately fed crossover switch networks to perform useful rotational and reflection permutations that exploit the selectable beam antenna's linear, polygonal, planar or polyhedral topology.

7. A selectable beam antenna according to claim 1 in which the antenna launch means exploits the topological rotational and reflection symmetries of the linear, polygonal, planar or polyhedral antenna surface to reduce the overall complexity and associated size of the antenna assembly.

8. A selectable beam antenna according to claim 1 in which the multiple pole, multiple throw radio frequency switch elements are radio frequency PIN diode switches, radio frequency micro-electromechanical devices or radio frequency plasma distribution devices.

9. A selectable beam antenna according to claim 1 in which the corporate feeds, distribution lines, time delays and amplitude weights that are associated the corporate feed means, the radio frequency switch network means and the radio frequency distribution means are constructed using microwave transmission lines on radio frequency printed circuit board, and the radio frequency switches and radio frequency crossovers are surface mounted on or wire-bound to the printed circuit board.

10. A selectable beam antenna according to claim 1 in which the antenna launch means are one dimensional or two dimensional arrays of corporately fed printed dipoles, Vivaldis, Yagis, spirals or patches.

11. A selectable beam antenna according to claim 1 in which the antenna launch means utilises corporately fed cross-over switch networks to perform useful rotational and reflection permutations that exploit the selectable beam antennas' linear, polygonal, planar or polyhedral topology.

12. A selectable beam antenna according to claim 1 in which the antenna launch means are printed circuit board structures in the form polygonal modules that can be interconnected to form rigid geodesic structures.

13. A selectable beam antenna according to claim 1 in which low noise amplifiers and power amplifiers are introduced into transmission lines to compensate for line losses and distribute power devices to so improve sensitivity and increase power transmitted respectively.

14. A selectable beam antenna according to claim 1 in which the polyhedral structures are transformed to conform to a geometric surface.

15. A selectable beam antenna according to claim 14 in which the geometric surface is the nose of an aircraft or the windscreen of a car.

* * * * *